US009286814B1

(12) United States Patent
Thomaselli et al.

(10) Patent No.: US 9,286,814 B1
(45) Date of Patent: Mar. 15, 2016

(54) PORTABLE SIGN ASSEMBLY

(71) Applicant: IMPACT INTERNATIONAL, Carson City, NV (US)

(72) Inventors: Robert Joseph Thomaselli, Carson City, NV (US); John Michael Brown, Ione, CA (US)

(73) Assignee: IMPACT INTERNATIONAL, Carson City, NV (US)

( * ) Notice: Subject to any disclaimer, the term of this patent is extended or adjusted under 35 U.S.C. 154(b) by 0 days.

(21) Appl. No.: 14/179,128

(22) Filed: Feb. 12, 2014

(51) Int. Cl.
*G09F 15/00* (2006.01)
*E01F 9/012* (2006.01)

(52) U.S. Cl.
CPC ..... *G09F 15/00* (2013.01); *E01F 9/012* (2013.01); *G09F 15/0062* (2013.01)

(58) Field of Classification Search
CPC .. G09F 15/0062; G09F 15/0025; E01F 9/012; E01F 13/02
USPC ..... 40/610, 777; 116/63 P
See application file for complete search history.

(56) References Cited

U.S. PATENT DOCUMENTS

| | | | | |
|---|---|---|---|---|
| 2,515,818 | A | | 7/1950 | Bennett |
| 3,165,847 | A | | 1/1965 | Gunderson |
| D271,218 | S | | 11/1983 | Farmer |
| D275,579 | S | | 9/1984 | Brown et al. |
| 5,458,434 | A | * | 10/1995 | Bent et al. ..... 404/6 |
| 5,621,992 | A | * | 4/1997 | Mandell et al. ..... 40/610 |
| 5,964,053 | A | * | 10/1999 | Liu ..... 40/610 |
| D427,242 | S | | 6/2000 | Pettesch |
| 6,131,320 | A | * | 10/2000 | Eberle et al. ..... 40/610 |
| 7,302,770 | B2 | | 12/2007 | Glass |
| 7,337,569 | B2 | | 3/2008 | Glass |
| D586,402 | S | | 2/2009 | Mangado Beloqui |
| D587,315 | S | | 2/2009 | Piantanida |
| 7,748,151 | B2 | | 7/2010 | Glass |
| 7,886,467 | B2 | | 2/2011 | Glass |
| D734,074 | S | | 7/2015 | Jouin |
| 2008/0190000 | A1 | * | 8/2008 | Glass ..... 40/610 |
| 2009/0193699 | A1 | * | 8/2009 | Benedict et al. ..... 40/606.12 |
| 2013/0269229 | A1 | | 10/2013 | Rodriguez-Aparicio, Sr. |

* cited by examiner

*Primary Examiner* — Joanne Silbermann
(74) *Attorney, Agent, or Firm* — Mschoff Brennan

(57) ABSTRACT

The subject matter disclosed herein generally relates to a sign assembly. In one embodiment, a sign assembly includes a first panel and a second panel. The first panel extends between an upper portion and an opposite lower portion. The second panel extends between an upper portion and an opposite lower portion. The first and second panels are pivotably coupled to one another about a pivot axis such that the sign assembly is positionable in an open configuration and a closed configuration. Further forms, embodiments, features, and aspects are disclosed herein.

9 Claims, 13 Drawing Sheets

PORTABLE SIGN ASSEMBLY

BACKGROUND

The present disclosure relates to sign assemblies which may be used for advertising, providing instruction or displaying information, amongst other things. Sign assemblies may be located indoors or outdoors. Some sign assemblies may be portable and thus may be repositioned in different locations.

The subject matter claimed herein is not limited to embodiments that solve any disadvantages or that operate only in environments such as those described herein. Rather, this background is only provided to illustrate one exemplary technology area where some embodiments described herein may be utilized.

BRIEF SUMMARY

The subject matter disclosed herein generally relates to sign assemblies. In one non-limiting embodiment, a sign assembly includes a first panel extending between an upper portion and an opposite lower portion. The lower portion may be configured to be positioned on a surface underlying the sign assembly. The first panel includes a receptacle positioned between the upper portion and the lower portion and configured to receive a placard. The receptacle includes a recessed surface substantially corresponding in size and shape to the placard and including a convex configuration.

In another non-limiting embodiment, a sign assembly includes a first panel and a second panel. The first panel includes a first hinge member spaced a first distance from a first edge of the first panel and a second hinge member spaced a second distance less than the first distance from a second edge of the first panel. The second panel includes a first hinge member and a second hinge member, the first hinge member spaced a first distance from a first edge of the second panel and the second hinge member spaced a second distance less than the first distance from a second edge of the second panel. The hinge members of the first panel are configured to engage with the hinge members of the second panel to pivotably couple the first and second panels to one another.

In still another embodiment, a sign assembly includes a first panel and a second panel. The first panel extends between an upper portion and an opposite lower portion and includes a first opening defining a first upper end. The second panel extends between an upper portion and an opposite lower portion and includes a second opening defining a second upper end. The first and second panels are pivotably coupled to one another about a pivot axis positioned below the first and second openings.

This Summary is provided to introduce a selection of concepts in a simplified form that are further described below in the Detailed Description. This Summary is not intended to identify key features or essential characteristics of the claimed subject matter, nor is it intended to be used as an aid in determining the scope of the claimed subject matter.

Additional features and advantages of the invention will be set forth in the description which follows, and in part will be obvious from the description, or may be learned by the practice of the invention. The features and advantages of the invention may be realized and obtained by means of the instruments and combinations particularly pointed out in the appended claims. These and other features of the present invention will become more fully apparent from the following description and appended claims, or may be learned by the practice of the invention as set forth hereinafter.

DETAILED DESCRIPTION

For purposes of promoting an understanding of the disclosed subject matter, reference will now be made to the following embodiments and specific language will be used to describe the same. It will nevertheless be understood that no limitation of the scope of the subject matter is thereby intended, such alterations and further modifications in the described subject matter, and such further applications of the principles of the invention as described herein being contemplated as would normally occur to one skilled in the art to which the invention relates.

The terms and words used in the following description and claims are not limited to the bibliographical meanings, but are merely used to enable a clear and consistent understanding of the subject matter. It is to be understood that the singular forms "a," "an," and "the" include plural referents unless the context clearly dictates otherwise. Thus, for example, reference to "a component surface" includes reference to one or more of such surfaces.

By the term "substantially" it is meant that the recited characteristic, parameter, or value need not be achieved exactly, but that deviations or variations, including for example, tolerances, measurement error, measurement accuracy limitations and other factors known to skill in the art, may occur in amounts that do not preclude the effect the characteristic was intended to provide.

The subject matter disclosed herein generally relates to sign assemblies. In one non-limiting embodiment, a sign assembly includes a first panel and a second panel which are pivotably coupled to one another. In this arrangement, the first and second panels may be pivoted relative to each other between open and closed configurations of the sign assembly. Further details regarding this and other subject matter is provided herein below.

Figure 3:
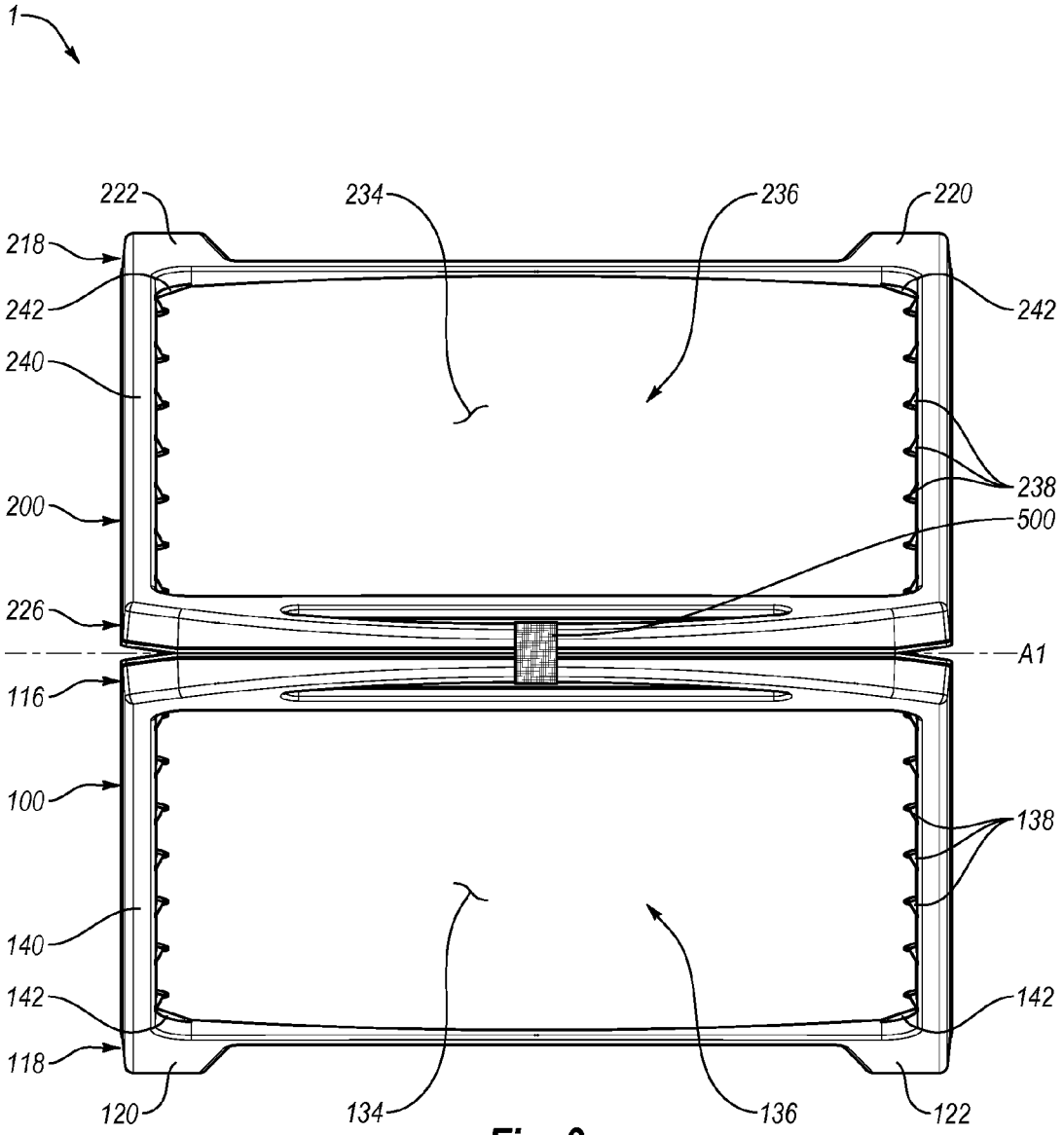
FIG. 3 is a top view of the sign assembly of FIG. 1 in an open configuration.
Figure 4:
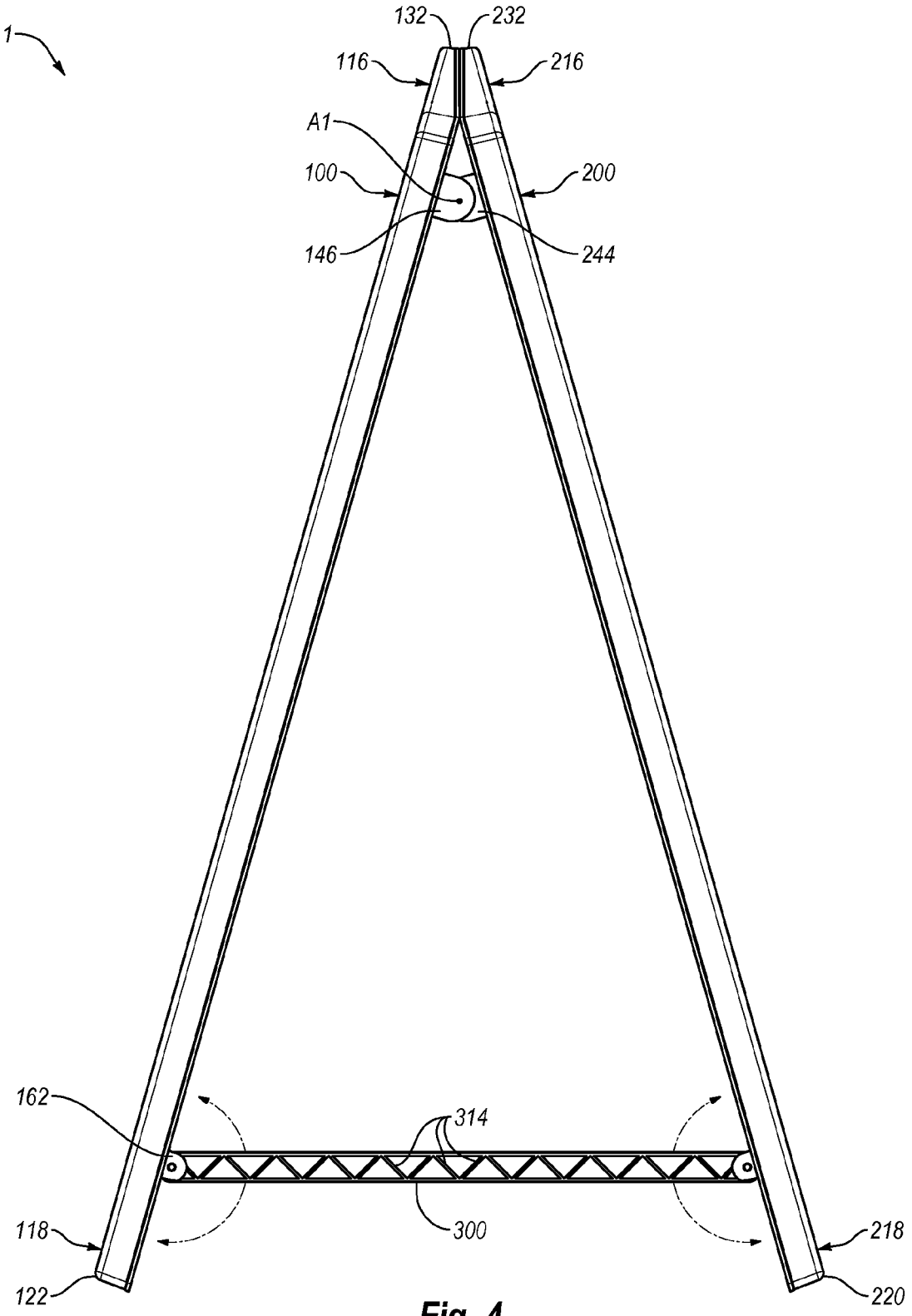
FIG. 4 is a side view of the sign assembly of FIG. 1 in an open configuration.
Figure 5:
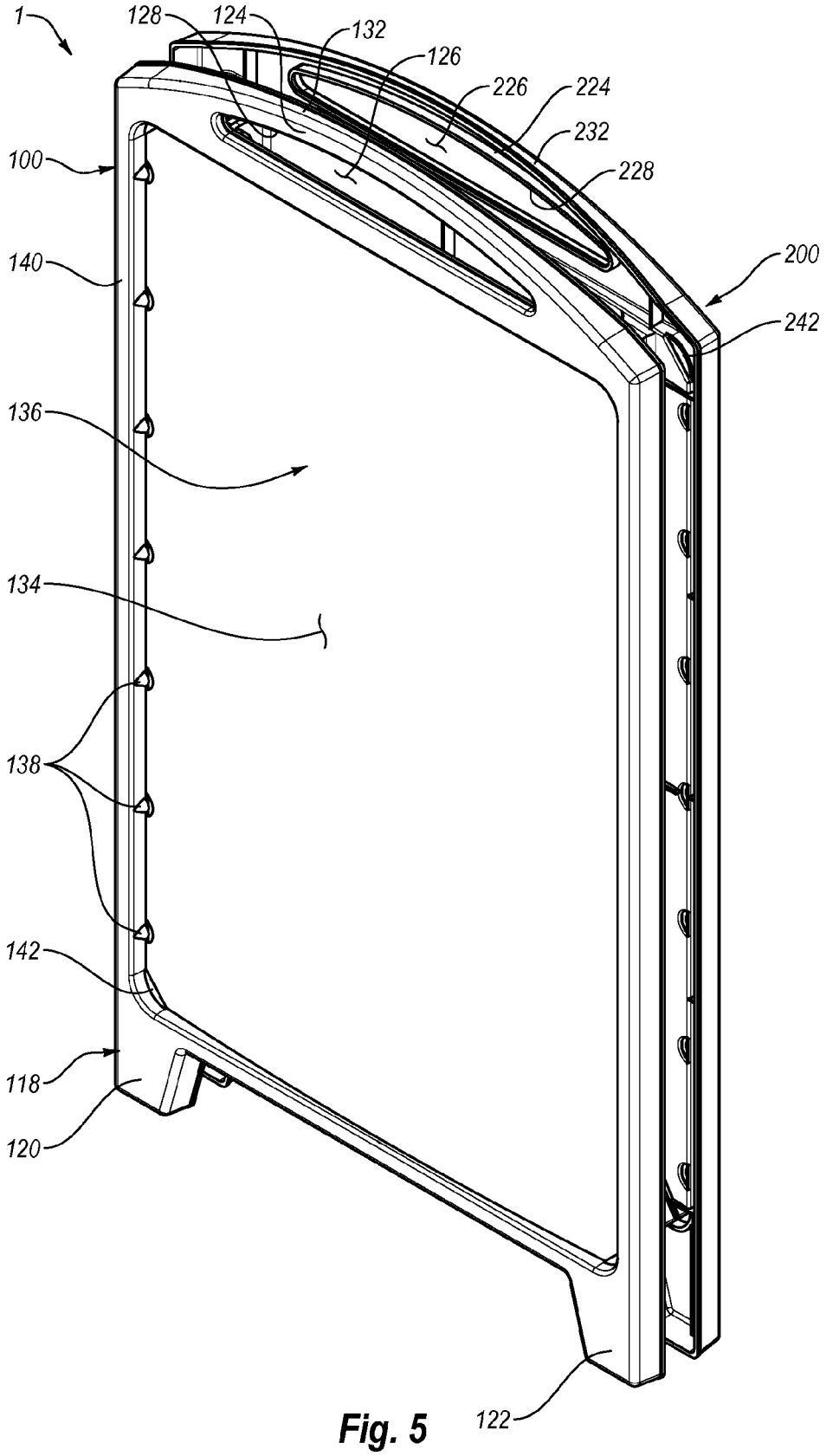
FIG. 5 is a perspective view of the sign assembly of FIG. 1 in a closed configuration.
Figure 6:
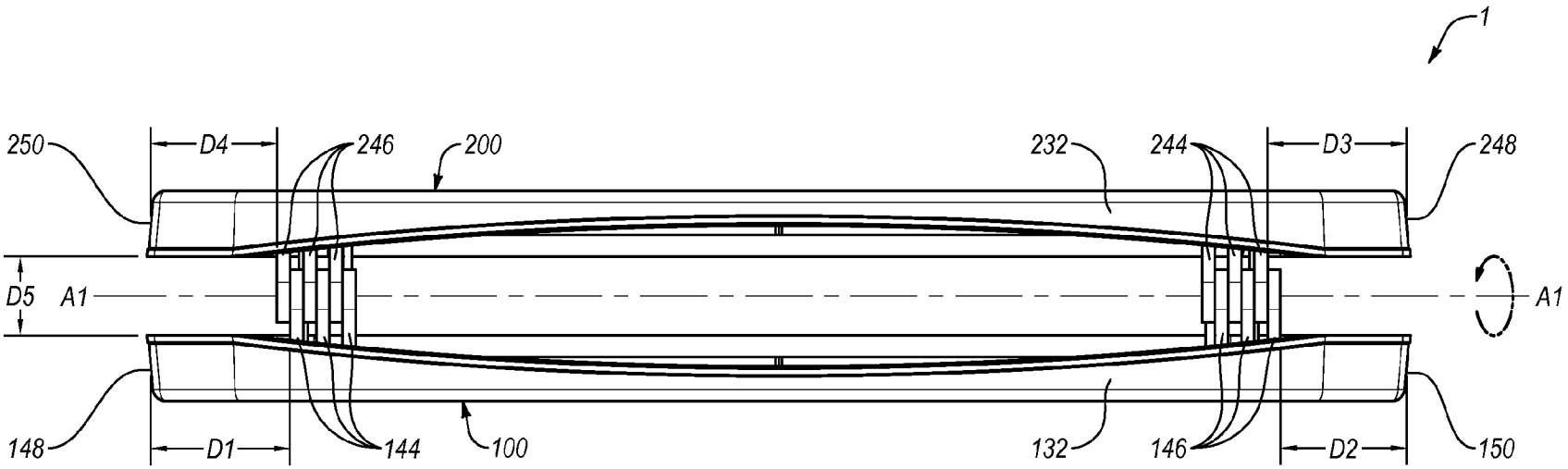
FIG. 6 is a top view of the sign assembly of FIG. 1 in a closed configuration.
Figure 7:
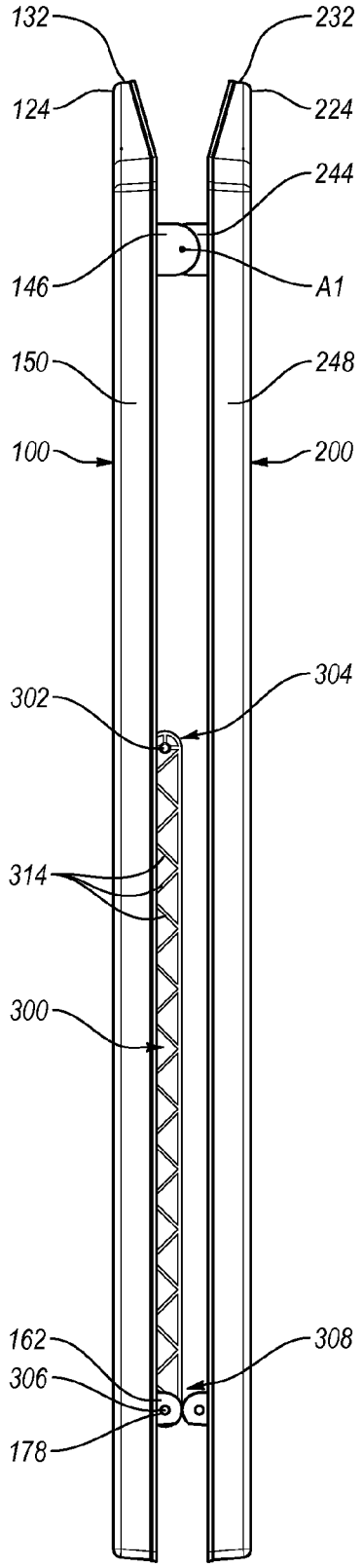
FIG. 7 is a side view of the sign assembly of FIG. 1 in a closed configuration.

More particularly, with general reference to FIGS. 1-7, one non-limiting embodiment of a sign assembly 1 is illustrated in various perspective, side and top views. Sign assembly 1 includes a first panel 100 and a second panel 200 which are pivotably coupled to one another such that sign assembly 1 may be positioned in an open configuration as illustrated in FIGS. 1-4 for example, and a closed configuration as illustrated in FIGS. 5-7 for example. Further details regarding features of the illustrated forms of the first panel 100 and the second panel 200 are provided below. It should be understood that in other non-illustrated embodiments, first panel 100 and second panel 200 may include one or more features in addition to or in lieu of those described in this document, or may include fewer features than those described herein.

A first panel 100 extends between an upper portion 116 and an opposite lower portion 118. The lower portion 118 is configured to be positioned on a surface underlying the sign assembly 1, such as a finished floor, pavement, or soil, just to provide a few non-limiting examples. More specifically, in the illustrated embodiment, the lower portion 118 includes a first leg 120 spaced apart from a second leg 122. In other non-illustrated embodiments, legs 120 and 122 may be omitted from the lower portion 118 and the lower portion 118 may be configured to directly engage a surface underlying the sign assembly 1 without legs 120 and 122. Alternatively, the lower portion 118 may include just one leg or more than two legs.

Figure 1:
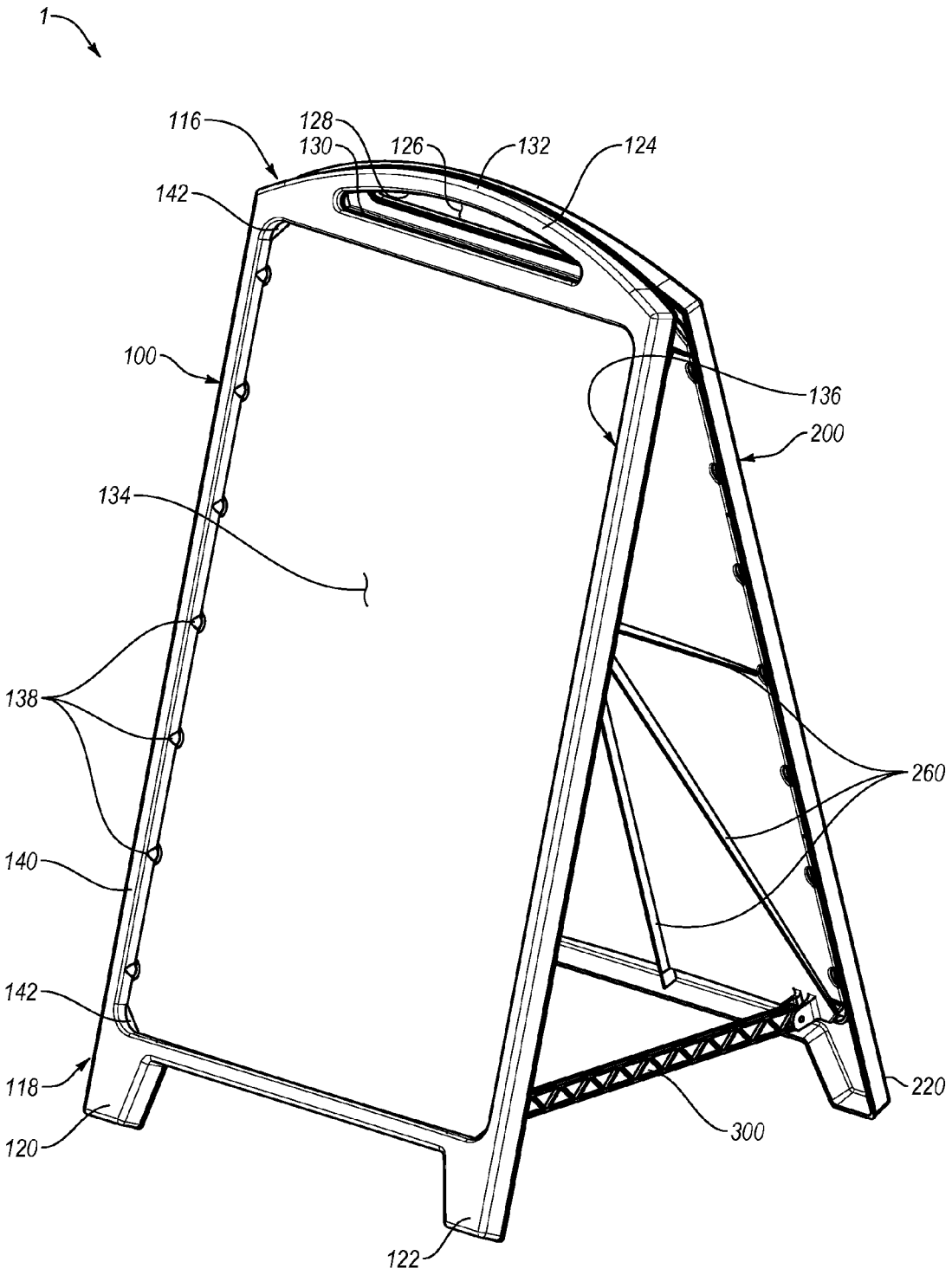
FIG. 1 is a perspective view of a sign assembly in an open configuration.

As illustrated for example in FIGS. 1 and 3, the first panel 100 includes a receptacle 136 positioned between the upper portion 116 and the lower portion 118. Receptacle 136 includes a surface 134 which is recessed relative to an outer surface 140 of first panel 100. Surface 134 includes a convex configuration which will be discussed in further detail below. The first panel 100 also includes a plurality of retaining members 138 positioned between recessed surface 134 and the outer surface 140. For the sake of clarity, only a few of retaining members 138 are identified in the Figures. The first panel 100 also includes openings 142, which are positioned at corners of receptacle 136 in the illustrated embodiment, although other variations are contemplated. The recessed surface 134, receptacle 136, retaining members 138, and the openings 142 will be discussed in further detail below.

As illustrated in FIGS. 1, 3, and 5 for example, the first panel 100 includes an opening 126 positioned between an upper end 124 of first panel 100 and the receptacle 136. The opening 126 includes an arcuate upper surface 128 opposite a linear lower surface 130. The upper end 124 includes an arcuate end surface 132 which generally corresponds to arcuate upper surface 128, although variations between surfaces 128 and 132 are possible. In non-illustrated embodiments, the arcuate upper surface 128 or the arcuate end surface 132 may be semi-circular, linear or any other configuration. Similarly, linear lower surface 130 is illustrated as an example only and may also be semi-circular, arcuate or any other configuration. Accordingly, in non-illustrated embodiments, the opening 126 may be substantially oval, circular, square, rectangular, elongate, or any other shape or configuration, including combinations of the foregoing shapes.

As illustrated for example in FIGS. 1 and 8-11, the opening 126 and the upper end 124 are configured to facilitate convenient transport and positioning of the sign assembly 1. For example, the upper end 124 can be used as a handle and a person may grasp the upper end 124 of the sign assembly 1 to manipulate its location. Additionally, a person may engage the sign assembly 1 by lifting on arcuate upper surface 128 by positioning at least a portion of their hand through the opening 126.

Figure 2:
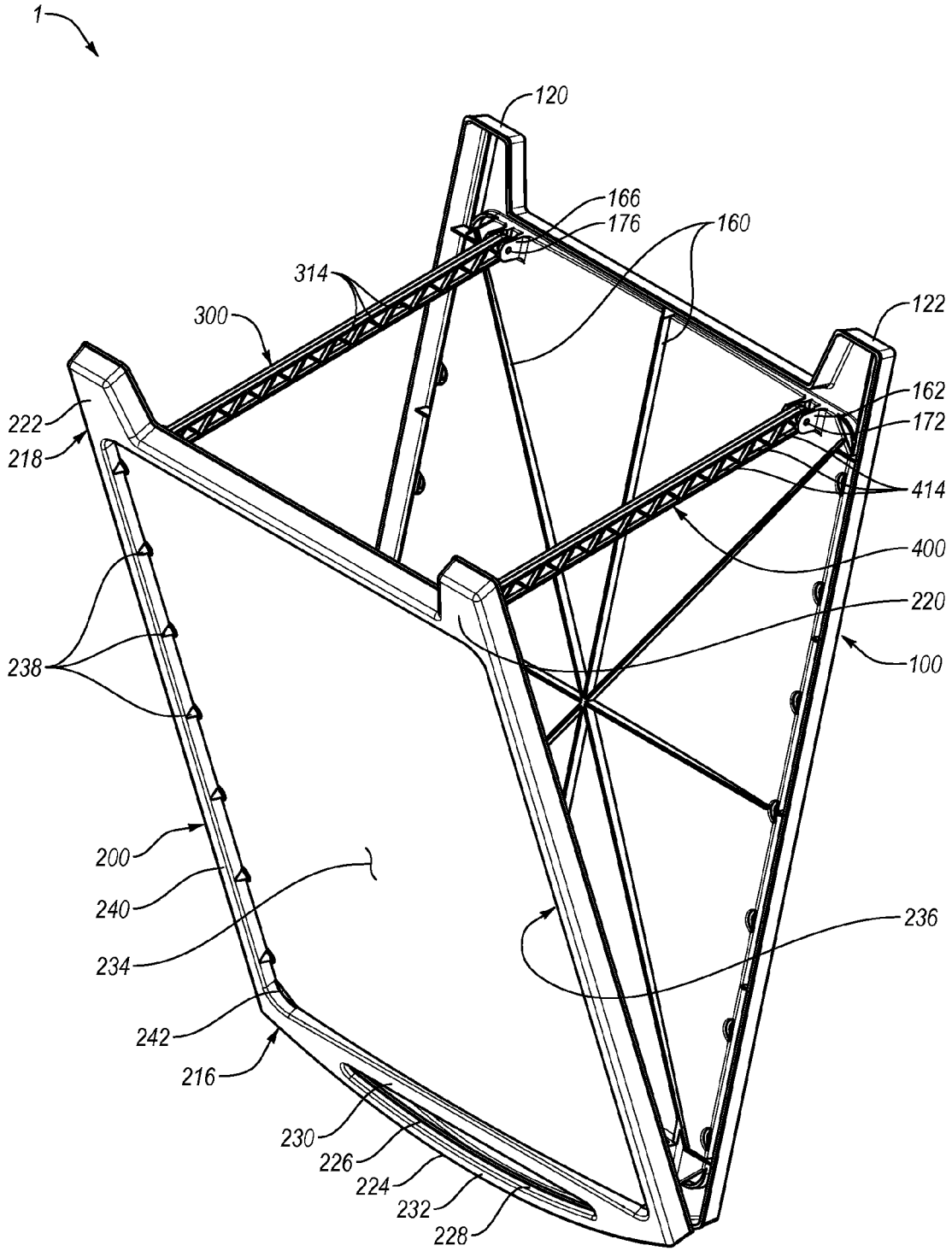
FIG. 2 is an alternative perspective view of the sign assembly of FIG. 1 in an open configuration.

Turning now to the second panel 200 and with more particular reference to FIGS. 2 and 3, the second panel 200 extends between an upper portion 216 and an opposite lower portion 218. It should be understood that the upper portion 216 and the lower portion 218 generally correspond to upper portion 116 and lower portion 118 of the first panel 100.

The lower portion 218 is configured to be positioned on a surface underlying the sign assembly 1, such as a finished floor, pavement, or soil, just to provide a few non-limiting examples. More specifically, in the illustrated embodiment, the lower portion 218 includes a first leg 220 spaced apart from a second leg 222. In other non-illustrated embodiments, legs 220 and 222 may be omitted from the lower portion 218 and the lower portion 218 may be configured to engage a surface underlying the sign assembly 1. Alternatively, the lower portion 218 may include just one leg or more than two legs.

As illustrated for example in FIG. 2, the second panel 200 includes a receptacle 236 positioned between the upper portion 216 and the lower portion 218. The receptacle 236 includes a surface 234 which is recessed relative to an outer surface 240 of the second panel 200. Surface 234 includes a convex configuration which will be discussed in further detail below. The second panel 200 also includes a plurality of retaining members 238 positioned between the recessed surface 234 and the outer surface 240. For the sake of clarity, only a few of the retaining members 238 are identified in the Figures. The second panel 200 also includes openings 242, which are positioned at corners of receptacle 236 in the illustrated embodiment, although other variations are contemplated. The recessed surface 234, receptacle 236, retaining members 238, and openings 242 will be discussed in further detail below.

As illustrated in FIG. 2 for example, the second panel 200 includes an opening 226 positioned between the upper end 224 of the second panel 200 and the receptacle 236. The opening 226 includes an arcuate upper surface 228 opposite a linear lower surface 230. The upper end 224 includes an arcuate end surface 232 which generally corresponds to arcuate upper surface 228, although variations between surface 228 and 232 are possible. In non-illustrated embodiments, the arcuate upper surface 228 or the arcuate end surface 232 may be semi-circular, linear or any other configuration. Similarly, linear lower surface 230 is illustrated as an example only and may also be semi-circular, arcuate or any other configuration. Accordingly, in non-illustrated embodiments, the opening 226 may be substantially oval, circular, square, rectangular, elongate, or any other shape or configuration, including combinations of the foregoing shapes.

The opening 226 and the upper end 224 are configured to facilitate convenient transport and positioning of the sign assembly 1. For example, the upper end 224 can be used as a handle and a person may grasp the upper end 224 of the sign assembly 1 to manipulate its location. Additionally, a person may engage the sign assembly 1 by lifting on arcuate upper surface 228 by positioning at least a portion of their hand through the opening 226.

In the illustrated embodiment of sign assembly 1, the first panel 100 and the second panel 200 are substantially identical. In this form, panels 100, 200 may facilitate, inter alia, more efficient manufacture of the sign assembly. For example, if all or part of the sign assembly 1 is molded, then the substantially identical relationship of panels 100, 200 may allow all or part of both panels to be manufactured using a single mold. Alternatively, the substantially identical relationship of panels 100, 200 may allow both panels to be manufactured using similar or substantially identical molds.

In non-illustrated embodiments, the first panel 100 and the second panel 200 may not have a substantially identical relationship. For example, one or more features described relating to the first panel 100 or the second panel 200 may be omitted without the corresponding feature on the other panel being omitted. The first panel 100 and the second panel 200 are pivotably coupled to one another such that sign assembly 1 may be positioned between an open configuration and a closed configuration. Turning to FIG. 6 for example, the first panel 100 includes hinge members 144 and 146 and the second panel 200 includes hinge members 244 and 246. Hinge member 144 of the first panel 100 engages with the hinge member 246 of the second panel 200. Similarly, hinge member 146 of the first panel 100 engages with the hinge member 244 of the second panel 200. As illustrated, each of hinge members 144, 146, 244, 246 include three sub-members, although variations in the configuration of hinge members 144, 146, 244, 246 are possible. A pin, bolt or other similar component (not shown) is positioned through aligned apertures of hinge members 144 and 246 and hinge members 146 and 244 in order to maintain engagement therebetween. An axis A1 extends through hinge members 144, 146, 244, 246 and defines a pivot axis about which the first panel 100 and the second panel 200 rotate with respect to each other.

The first panel 100 also includes oppositely positioned lateral edges 148 and 150 and the second panel 200 includes oppositely positioned lateral edges 248 and 250. The lateral most sub-member of hinge member 144 is spaced inwardly from lateral edge 148 at a distance D1. The lateral most sub-member of hinge member 146 is spaced inwardly from lateral edge 150 at a distance D2. The lateral most sub-member of hinge member 244 is spaced inwardly from lateral edge 248 at a distance D3. The lateral most sub-member of hinge member 246 is spaced inwardly from lateral edge 250 at a distance D4.

Distance D2 is less than distance D1 and distance D4 is less than D3. Distance D1 is substantially the same as distance D3, and distance D2 is substantially the same as distance D4. The difference between the distances D1 and D3 with respect to D2 and D4 is substantially equal to the width of a sub-member of hinge members 144, 146, 244, 246. This positioning allows hinge member 144 to properly engage with hinge member 246 and hinge member 146 to engage with hinge member 244. Additionally, the positioning permits edge 148 to be substantially aligned with edge 250 when the first panel 100 and the second panel 200 are pivotably coupled. Similarly, the positioning permits edge 150 to be substantially aligned with edge 248 when the first panel 100 and the second panel 200 are pivotably coupled.

Amongst other things, the aligned edges may protect the sign assembly 1 from damage in case of a side impact to the sign assembly 1 by distributing the force of the impact to both aligned edges, and/or eliminate a protruding edge which can be engaged by wind, a passer-by or other force that displaces sign assembly 1.

In non-illustrated embodiments, the edges 148, 250 or 150, 248 may not be aligned. Furthermore, D1 may not be equal to D3 and D2 may not be equal to D4. In some embodiments, D2 may not be less than D1 and/or D4 may not be less than D3. Non-illustrated embodiments include sign assemblies in which distances D1, D2, D3, and D4 may be interchanged in a variety of alternative configurations.

Additionally, while the widths of the sub-members of hinge members 144, 146, 244, 246 are illustrated as being substantially equal, it should be understood that the sub-members may include varying widths in non-illustrated forms. Furthermore, non-illustrated sign assemblies include embodiments where hinge members 144, 146, 244, 246 have any number of sub-members or a single sub member. For example, in one non-limiting embodiment, sign assembly 1 includes the first panel 100 which has only one hinge member and second panel 200 which only has one hinge member. In this form, the single hinge member on each of first and second panels 100, 200 may extend across all or part of the distance between lateral edges 148, 150 and 248, 250, respectively. Alternatively, the first panel 100 may have any number of hinge members and the second panel 200 may have any number of hinge members.

Figure 10:
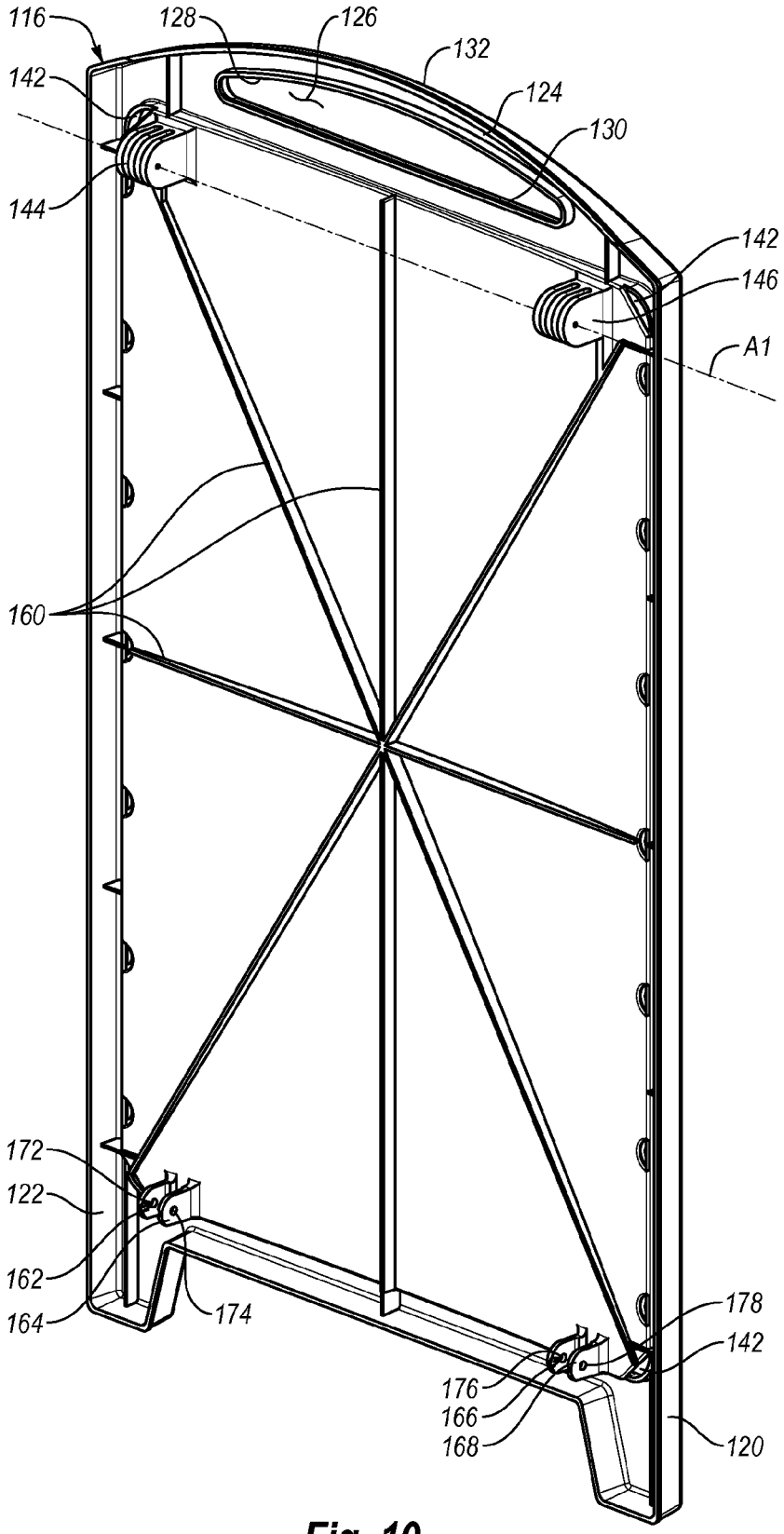
FIG. 10 is an alternative perspective view of the first panel illustrated in FIG. 8.
Figure 11:
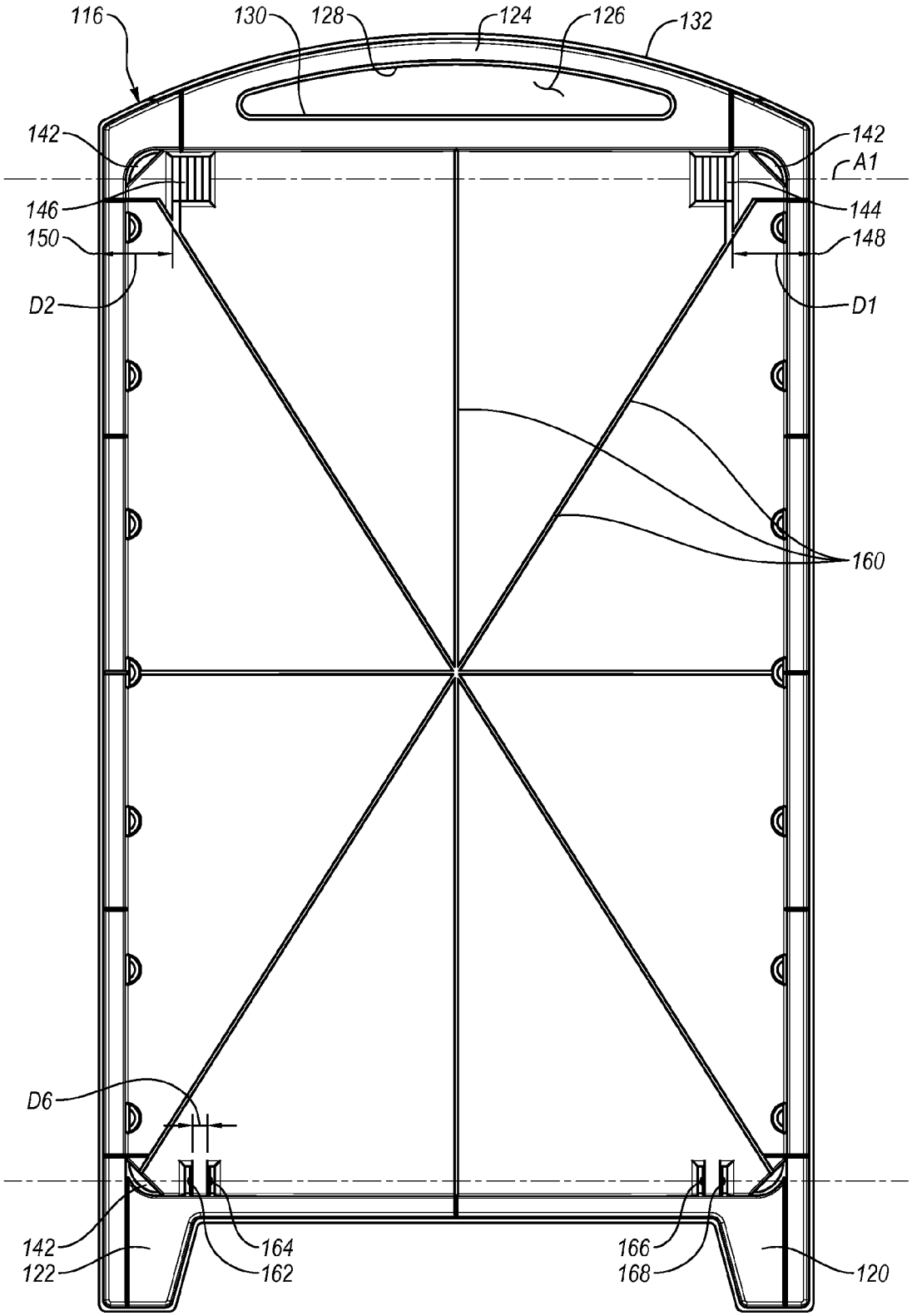
FIG. 11 is a rear view of the first panel illustrated in FIG. 8.
Figure 12:
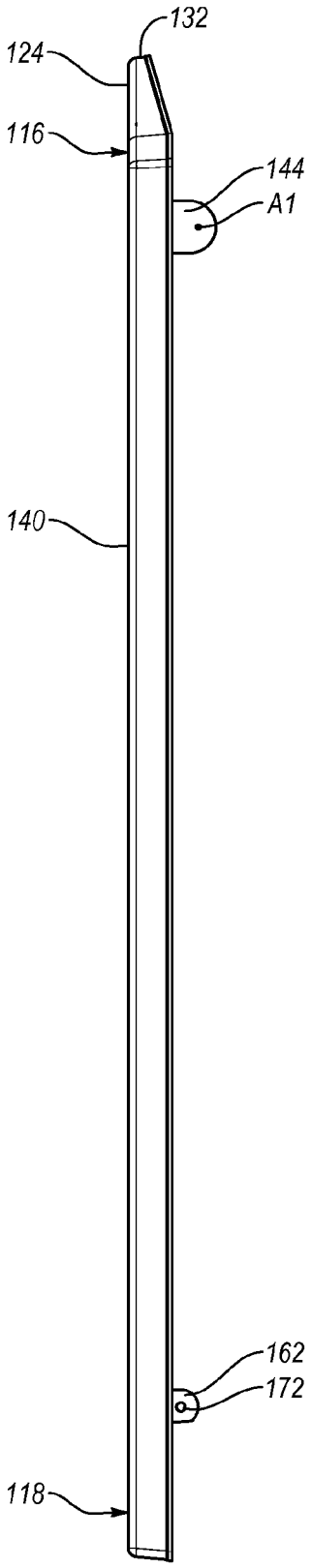
FIG. 12 is a side view of the first panel illustrated in FIG. 8.

As illustrated in FIGS. 10 and 11, hinge members 144 and 146 and axis A1 are positioned below the opening 126 and the upper end 124. In this embodiment, opening 126 does not extend to either hinge members 144 or 146. The positioning and the features of the first panel 100 substantially correspond to the positioning and features of the second panel 200. For example, in the illustrated embodiment, hinge members 244, 246, the opening 226, and the upper end 224 are substantially identical in structure and positioning to the corresponding features of the first panel 100. However, non-illustrated embodiments contemplate sign assemblies including first and second panels 100, 200 with non-identical features and or positioning of such features.

The hinge members 144, 146, 244, and 246 positioned at distances D1, D2, D3, and D4 relative to lateral edges 148, 150, 248, 250 and below upper ends 124, 224 may be such that the hinge members 144, 146, 244, and 246 are shielded or protected from an impact to the sign assembly 1. Additionally or alternatively, such positioning may also protect the hinge members 144, 146, 244, and 246 from weather damage when the sign assembly 1 is in the open configuration, such as for example, deterioration from prolonged sun exposure or moisture damage from rain, snow or other precipitation.

Amongst other things, the configuration of the sign assembly 1 may reduce or prevent interference with or manipulation of the hinge members 144, 146, 244, 246 when the sign assembly 1 is in the open configuration. For example, when the sign assembly 1 is in the open configuration, as illustrated in FIGS. 3 and 4 for example, the upper portions 116 and 216 generally obstruct access to the hinge members from the top of the sign assembly 1. Further, when sign assembly 1 is in the open configuration, the distances D1, D2, D3, and D4 from lateral edges 148, 150, 148, 250 may reduce or prevent interference with or manipulation of the hinge members 144, 146, 244 from the sides of the sign assembly 1.

The configuration of the sign assembly 1 may also reduce or prevent interference with or manipulation of the hinge members 144, 146, when the sign assembly 1 is in the closed configuration. For example, the distances D1, D2, D3, and D4 from lateral edges 148, 150, 248 and 250 may be such that the hinge members are not readily accessible or reachable when the sign assembly 1 is in the closed configuration. As illustrated in FIG. 6 for example, a distance D5 between the first panel 100 and the second panel 200 and the positioning of the hinge members below the upper ends 124, 224 may be such that access to hinge members 144, 146, 244, and 246 is generally obstructed.

In addition, the configuration of the sign assembly 1 may be such that interference with, damage to or manipulation of the hinge members 144, 146, 244 and 246 is reduced or prevented in either the closed or open configurations.

As indicated above, a pin, bolt or other similar component (not shown) is positioned through aligned apertures of hinge members 144 and 246 and hinge members 146 and 244 in order to maintain engagement therebetween. In other embodiments, the hinge members 144, 146, 244, 246 may include other hinge structures to couple the corresponding hinge members to pivotably connect the first panel 100 and the second panel 200. For example, hinge member 144 may include projections which engage with corresponding receptacles in hinge member 246 or vice versa, and/or hinge member 146 may include projections which engage with corresponding receptacles in hinge member 244 or vice versa.

As illustrated in FIGS. 10 and 11, the first panel 100 includes ribs or struts 160 configured to provide reinforcement to the first panel 100. Specifically, the ribs 160 are positioned on a side of the recessed surface 134 facing second panel 200 and may contribute to the structure of the convex configuration of recessed surface 134 discussed below. The second panel 200 also includes ribs or struts 260 (FIG. 1) configured to provide reinforcement to the second panel 200. Specifically, the ribs 260 are positioned on a side of the recessed surface 234 facing first panel 100 and may contribute to the structure of the convex configuration of recessed surface 234 discussed below.

Figure 8:
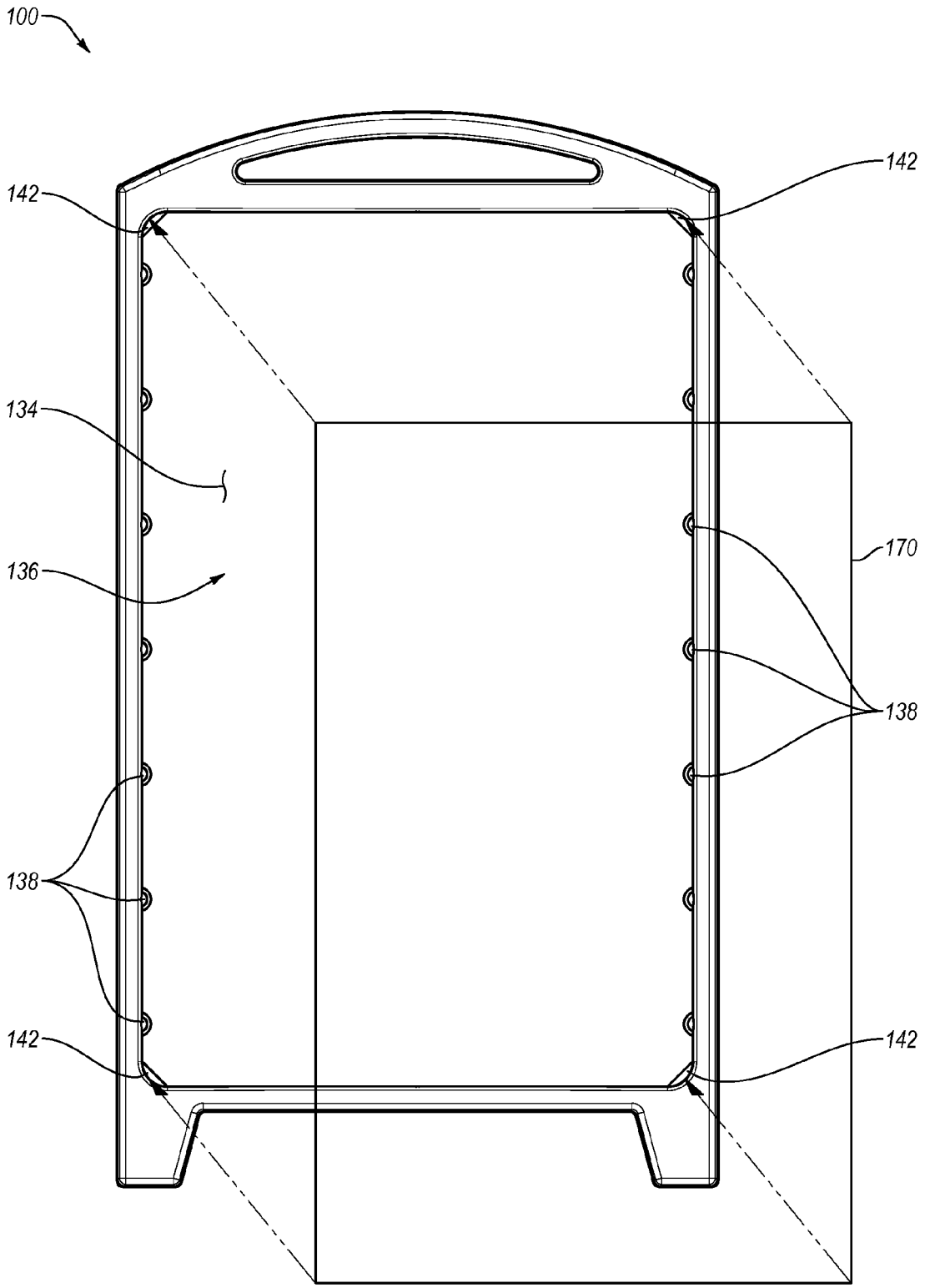
FIG. 8 is a front view of a first panel of the sign assembly of FIG. 1.

As illustrated in FIG. 8, the receptacle 136 is configured to receive a placard 170. Each of the plurality of retaining members 138 define a space configured to receive a portion of the placard 170 between the recessed surface 134 and the respective retaining member 138. When the placard 170 is placed in the receptacle 136, the plurality of retaining members 138 retain the placard 170 in receptacle 136.

Although the illustrated embodiment includes a number of the plurality of retaining members 138, it should be understood that in non-illustrated embodiments, first panel 100 may include any number of retaining members 138, including only one retaining member 138 or none at all. In certain forms, the retaining members 138 may be elongate or may be channels configured to receive a portion of the placard 170. The retaining members 138 may be positioned anywhere on the sign assembly, and are not limited to edges of the panels. In some embodiments, additional retaining members 138 may be located near features similar to the upper portion 116 and/or similar to the lower portion 118.

As illustrated in the Figures, the openings 142 extend through the recessed surface 134 and are configured to receive a corner of the placard 170. When the placard 170 is placed in the receptacle 136, the corners of the placard 170 positioned in the openings 142 also assist in retaining the placard 170 in the receptacle 136. Forms in which openings 142 are omitted and only retaining members 138 retain placard 170 in receptacle 136 are also possible, and it is also possible that panel member 100 only includes openings 142 in the absence of retaining members 38 to retain placard 170 in receptacle 136.

In the illustrated embodiment, the placard 170 includes a rectangular configuration. However, in non-illustrated embodiments, the placard may have an alternatively shaped configuration, including, for example, square, circular, oval, or any other shape or any combination thereof.

The first panel 100 includes four openings 142, although it should be understood that variations in the number of openings 142 are possible. In forms where placard 170 includes a configuration having one or more corners, the number of openings 142 may correspond to the number of corners of the placard 170. In other embodiments, the number of openings 142 may be more or less than the number of corners of the placard 170. In forms where placard 170 includes a configuration that is free from corners or includes rounded corners, placard 170 may be retained in receptacle 136 by retaining members 138 only and without assistance from openings 142 which may or may not be omitted from panel 100.

Figure 9:
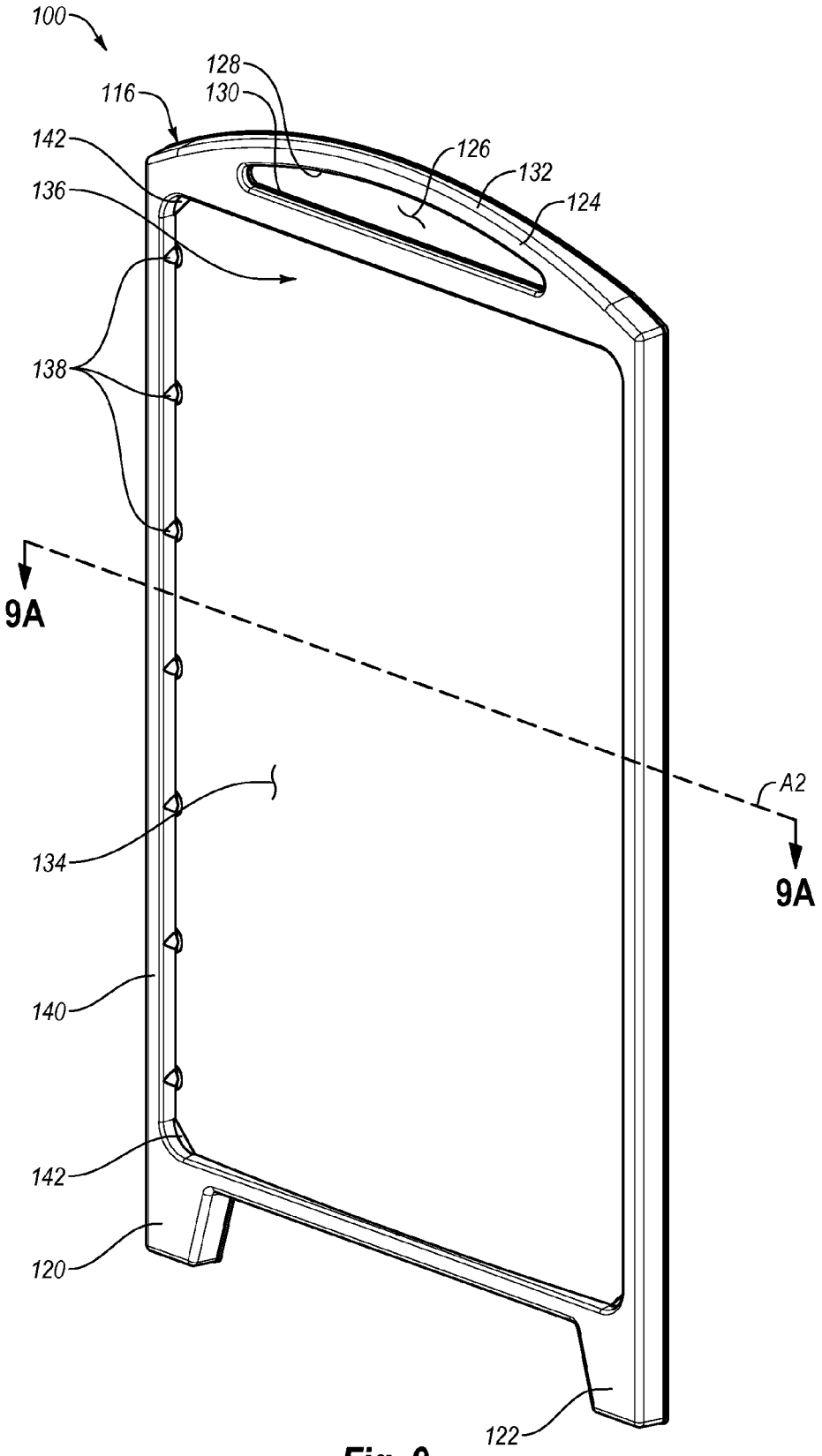
FIG. 9 is a perspective view of the first panel illustrated in FIG. 8.
Figure 9A:
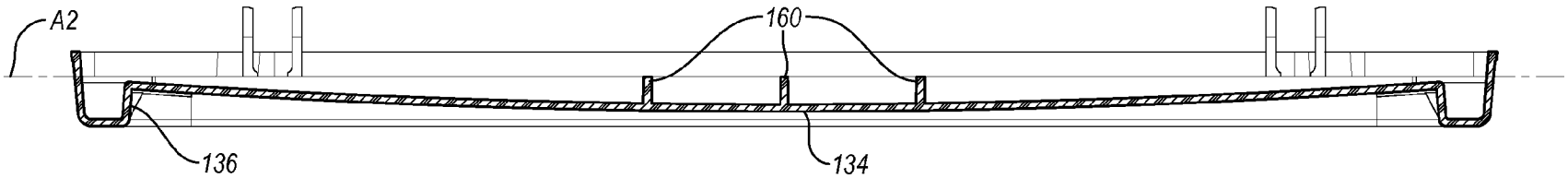
FIG. 9A is a section view of the first panel taken along view line 9A-9A of FIG. 9.

Referring now to FIGS. 9 and 9A, further details regarding the convex configuration of recessed surface 134 will be provided. The recessed surface 134 includes a convexity extending along an axis A2 as illustrated in the cross-section view of FIG. 9A taken along view line 9A-9A in FIG. 9. In other embodiments, the recessed surface 134 may also include a convexity extending along an axis orthogonal to axis A2. The convex configuration of recessed surface 134 is also illustrated in FIG. 3 as well as other figures.

The convex configuration of the recessed surface 134 provides the placard 170 with a convex configuration corresponding to the convex configuration of recessed surface 134 when the placard 170 is placed in the receptacle 136. In one form, the placard 170 is substantially planar and resilient such that, if deformed, it is disposed to recoil or spring back to its planar shape. When the placard 170 is placed in the receptacle 136 and obtains a convex configuration from recessed surface 134, the resilience of the placard 170 assists in retaining placard 170 in the receptacle 136. More particularly, the resilience of the placard 170 may dispose portions of the placard 170 against the plurality of retaining members 138 to assist in retaining the placard 170 in the receptacle 136. Additionally or alternatively, the resilience of the placard 170 may dispose corners of the placard 170 against the first panel 100 near the openings 142 to retain the placard 170 in the receptacle 136.

As illustrated in FIGS. 1, 2 and 4 for example, a strut 300 is removably coupled to the first panel 100 and the second panel 200. The strut 300 can also be referred to as a cross member. Referring now to FIG. 7, the strut 300 includes a protrusion 302 and an oppositely positioned protrusion (not shown) on a first end 304 and a protrusion 306 and an oppositely positioned protrusion (not shown) on a second end 308.

The strut 300 includes support members 314. For the sake of clarity, only a few of the support members 314 are identified in the Figures. The support members 314 are arranged in a triangular pattern and run the length of the strut 300 and can provide structural support to the strut 300. In non-illustrated forms, there may be any number of support members 314 or no support members. Alternatively, in non-illustrated forms the support members 314 may not run the entire length of the strut 300. Support members 314 may also be arranged in a pattern other than the illustrated triangular pattern. For example, support members 314 may be arranged in a square, rectangular, cross-hatch, or any other configuration that provides structural support.

As illustrated in FIG. 2 for example, the sign assembly 1 includes a second strut 400. The second strut 400 substantially corresponds to strut 300 and also includes oppositely positioned protrusions on opposite first and second ends. Strut 400 also includes support members 414 which may be include the same configuration as described above in connection with support member 314 of strut 300. In non-illustrated forms, sign assembly 1 may include any number of struts that may be similar to strut 300 or strut 400 or may not include any struts or similar structures.

Referring now to FIGS. 10 and 11 for example, the first panel 100 includes coupling members 162, 164, 166 and 168. The coupling members 162, 164, 166 and 168 each include corresponding openings 172, 174, 176, and 178 (illustrated in FIG. 10). Each opening 172, 174, 176, and 178 is configured to receive any one of the protrusions of strut 300. The coupling members 162, 164, 166 and 168 are positioned substantially orthogonal to a plane corresponding to the first panel 100. The coupling members 162, 164, 166 and 168 are resilient and tend to return to the substantially orthogonal position when deformed. The second panel 200 also includes coupling members, some of which may not be shown in the Figures, which are substantially similar and correspond to the coupling members of the first panel 100. The coupling members of second panel 200 also include corresponding openings, some of which may not be shown in the Figures.

The coupling members of first panel 100 and second panel 200 are arranged in corresponding pairs. For example, coupling members 162 and 164 define a first pair while coupling members 166 and 168 define a second pair. Each corresponding pair of coupling members forms snap hinge couplings configured to facilitate removable coupling with the struts 300, 400. The coupling members of each corresponding pair are positioned a distance D6 from each other. Distance D6 may be substantially equal to a width of the struts 300, 400, although it should be understood that distance D6 may also be slightly less than the width of the struts 300, 400 because the coupling members are resilient.

One end of struts 300, 400 may be inserted between a corresponding pair of coupling members. For example, the first end 304 of strut 300 may be inserted between coupling members 162, 164. Coupling members 162 and 164 may be deformed from their orthogonal position to allow the first end 304 including the protrusions to be inserted in between the coupling members 162 and 164. The first end 304 may be positioned such that the protrusions are aligned with openings 172 and 174 such that when the coupling members 162 and 164 return to their orthogonal positions the first end 304 is removably coupled to the first panel 100. This attachment may also be referred to as a snap hinge attachment or snap hinge coupling configuration. Either end of the struts 300 and 400 may be similarly inserted into any of the corresponding pairs of coupling members for attachment to either the first panel 100 or the second panel 200.

In the illustrated example, the struts 300 and 400 are substantially identical on their respective first and second ends. This configuration allows any end of the strut 300 to interchangeably engage to any of the corresponding coupling members. Additionally, the struts 300 and 400 are configured such that the struts may be rotated 180 degrees around their respective longitudinal axis and interchangeably engage to any of the corresponding coupling members.

In non-illustrated embodiments, struts similar or differing from struts 300 and 400 may couple to only one of the coupling members of first and second panels 100, 200. In addition, a panel may have any number of coupling members and the struts may be configured to couple to any number of coupling members. In some variations, the sign assembly may include only one strut or may include any number of struts. In other non-illustrated forms, struts 300, 400 may be omitted from sign assembly 1.

Sign assembly 1 may be positioned between an open configuration as illustrated in FIGS. 1-4 for example, and a closed configuration as illustrated in FIGS. 5-7 for example. When the sign assembly 1 is in the closed position, the first panel 100 and the second panel 200 are substantially parallel. In the closed position the sign may be carried by a person by either upper end 124 or upper end 224, or both.

The configuration of the hinge members 144, 146, 244 and 246 extending from the first and second panels 100, 200 and positioned below the upper ends 124, 224 helps facilitate movement of sign assembly 1 to the open configuration. For example, one or both of the upper ends 124, 224 may be displaced towards each other and thereby provide a lever-like action that pivots one or both of the panels 100, 200 to the open configuration as illustrated in FIG. 4.

The sign assembly 1 may be configured such that both of the upper ends 124, 224 may be grasped by one hand of a person when the sign assembly 1 is in the closed configuration. Using only one hand, a person may displace the upper ends 124, 224 towards each other to move the sign assembly 1 to the open configuration. The configuration of the sign assembly 1 may be such that leverage of the configuration of the sign assembly 1 may assist in opening the sign assembly 1 with one hand.

Even in forms where the sign assembly 1 is configured such that both of the upper ends 124, 224 may not be grasped by one hand of a person, the leverage provided by the configuration of the sign assembly 1 may assist in positioning the sign assembly 1 in the open configuration.

In the illustrated form, when the sign assembly 1 is in the open position, the upper end 124 is engaged with the upper end 224 (FIG. 3). Engagement of the upper ends 124 and 224 may add to stability of the sign assembly 1 when it is in the open position. Additionally, engagement of the upper ends 124 and 224 may protect the hinge members and/or struts. In non-illustrated forms, upper ends similar to 124 and 224 may be positioned close to each other but may not be engaged when the sign assembly 1 is in the open configuration.

Referring now to FIG. 3, the sign assembly 1 may also include a retaining element 500. The retaining element 500 is configured to retain the upper ends 124 and 224 in engagement with or in close proximity to one another when the sign assembly 1 is in the open configuration. The retaining member 500 may be configured to directly engage the upper ends 124, 224, and may be, for example, in the form of a strap, hook and loop strap, cable, line or wire or any similar component. Retaining member 500 may also be may be any type of fastener that mechanically or otherwise retains the upper ends 124 and 224 in engagement or close proximity to one another, non-limiting examples of which include bolts, screws, buckles, buttons, cable ties, clamps, clasps, clips, pins, latches, slides, grommets, rings, ties, and magnets. In the illustrated form, retaining element 500 is positioned through openings 126, 226 and around the upper ends 124, 224 to retain the upper ends 124, 224 in engagement, although other variations in the positioning of retaining element 500 are possible.

When the sign assembly 1 is in the closed configuration, the retaining element 500 may be engaged with one panel of the sign assembly 1, or it may be removed from the sign assembly 1. In other examples, the retaining element 500 may be configured to engage both panels 100, 200 when the sign assembly 1 is in the closed configuration in order to maintain sign assembly 1 in the closed configuration.

The struts 300 and 400 may be coupled to both the first panel 100 and the second panel 200 to help retain the sign assembly 1 in the open position. The struts 300 and 400 may also be disengaged from either the first panel 100 or the second panel 200 as illustrated for example in FIG. 6. When either strut 300 or 400 is disengaged from one panel and engaged with the other panel, the strut may pivotably rotate as illustrated by rotational lines in FIG. 4. The struts 300, 400 may rotate about an axis of rotation defined by the protrusions of struts 300, 400.

The axes that the struts 300 and 400 rotate about are substantially parallel to the axis of rotation A1 of the hinge members 144, 146, 244 and 246 coupling the first panel 100 and the second panel 200.

The struts 300 and 400 may be disengaged from either the first panel 100 or the second panel 200 such that the struts 300, 400 may be rotated to a folded position as illustrated for example in FIG. 6. When the struts 300, 400 are in the folded position, the sign assembly 1 may be positioned to the closed configuration. The struts 300, 400 may be rotated to a folded position along either the first panel 100 or the second panel 200 because the snap hinge attachments may be disconnected from either panel. Furthermore, the struts 300, 400 may be completely disconnected from the sign assembly 1 and removed.

The present invention may be embodied in other specific forms without departing from its spirit or essential characteristics. The described examples are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. A sign assembly, comprising a first panel extending between an upper portion and an opposite lower portion configured to be positioned on a surface underlying the sign assembly, the first panel defining a receptacle positioned between the upper portion and the lower portion and configured to receive a placard, wherein the receptacle includes a recessed surface on a first side of the receptacle substantially corresponding in size and shape to the placard and including a convex configuration, and a pair of spaced apart hinges positioned on the receptacle on a second side of the receptacle opposite the first side, wherein the recessed surface is recessed with respect to an outer surface of the first panel and comprises a plurality of retaining members protruding from a surface extending between the recessed surface and the outer surface of the first panel, each of the plurality of retaining members defining a space configured to receive a portion of the placard between the recessed surface and the respective retaining member.

2. The sign assembly of claim 1, wherein the convex configuration of the recessed surface includes a convexity extending along a first axis between the upper portion and the lower portion.

3. The sign assembly of claim 2, wherein the convex configuration of the recessed surface further includes a convexity extending along a second axis extending orthogonal to the first axis.

4. The sign assembly of claim 1, wherein the receptacle is configured to provide the placard with a convex configuration corresponding to the convex configuration of the recessed surface when the placard is positioned in the receptacle.

5. The sign assembly of claim 1, wherein the first panel further includes one or more openings extending through the recessed surface of the receptacle, each of the one or more openings being configured to receive a corner of the placard.

6. The sign assembly of claim 1, wherein the first panel further comprises a pair of spaced apart strut hinge couplings protruding from the second side.

7. The sign assembly of claim 1, further comprising a second panel pivotably coupled to the first panel.

8. The sign assembly of claim 7, wherein the second panel includes a pair of spaced apart hinges, the spaced apart hinges of the first panel being configured to engage with the spaced apart hinges of the second panel to couple the first and second panels to one another.

9. The sign assembly of claim 7, further comprising at least one cross member configured to extend between and engage with one or both of the first and second panels, wherein the at least one cross member is rotatable relative to the first panel or the second panel when the cross member is engaged to only one of the first panel and the second panel.

* * * * *